US005139089A

United States Patent [19]

Wacker

[11] Patent Number: 5,139,089

[45] Date of Patent: Aug. 18, 1992

[54] WELL CLEANOUT TOOL AND METHOD

[75] Inventor: Samuel L. Wacker, Roosevelt, Utah

[73] Assignee: GCW Development, Jackson, Wyo.

[21] Appl. No.: 713,729

[22] Filed: Jun. 11, 1991

[51] Int. Cl.[5] ..... E21B 21/10; E21B 37/00

[52] U.S. Cl. ..... 166/311; 166/105.3; 166/105.4; 166/107; 166/325; 175/308

[58] Field of Search ..... 166/311, 105.1, 105.3, 166/105.4, 107, 162, 167, 169, 99, 325; 175/308, 234, 242

[56] References Cited

U.S. PATENT DOCUMENTS 4,190,113 2/1980 Harrison ..... 166/311
4,421,182 12/1983 Moody et al. ..... 166/105.1 X
4,478,285 10/1984 Caldwell ..... 166/311
4,711,299 12/1987 Caldwell et al. ..... 166/311 X
4,721,156 1/1988 Campbell ..... 166/105.3 X
4,924,940 5/1990 Burroughs et al. ..... 175/324 X
4,940,092 7/1990 Ferguson et al. ..... 166/311

*Primary Examiner*—Stephen J. Novosad
*Attorney, Agent, or Firm*—J. Winslow Young

[57] ABSTRACT

A cleanout tool for removing debris from a deep borehole, the borehole being characterized by having a relatively low hydrostatic head or level of liquid in the borehole. A series of unique check valves acting in cooperation with a pumping section are used to collect the debris into the debris reservoirs while passing the liquid upwardly through the cleanout tool. The check valves are unique in the fact that they are less prone to plugging and two sets are supplied in pairs so as to provide an extra margin of valving efficiency. The cleanout tool is operable in under low hydrostatic head conditions due to its improved pumping efficiency.

15 Claims, 7 Drawing Sheets

WELL CLEANOUT TOOL AND METHOD

BACKGROUND

1. Field of the Invention

This invention relates to cleanout tools for oil and gas wells, and, more particularly, to an improved cleanout tool and method for removing debris from a well having a low fluid level, the cleanout tool having only one service break while being simpler to assemble and operate in addition to providing for a more efficient cleaning of the well.

2. The Prior Art

An oil or gas well is a borehole drilled deep into the earth until it penetrates through the particular formation or formations from which the hydrocarbons of interest are to be extracted. The well is drilled into the earth at depths generally between about 1000 meters and 6,000 meters. Customarily, drilling to these depths is accomplished with a rotary drill system wherein a drill bit is mounted on the bottom of a hollow, rotatable drill stem, the drill stem being assembled from a plurality of lengths of drill pipe. The lengths of drill pipe are progressively added to the upper end of the drill stem as drill bit progresses downwardly through the various types of rock to create the borehole. A drilling fluid is forced downwardly through the hollow drill stem and is ejected a jets at the drill bit to lubricate the drill bit and to remove the cuttings away from the drill bit and to carry them to the surface. The drilling fluid is recovered, processed, and recycled through the drill stem.

As the drilling progresses downwardly, a steel casing is inserted as a liner into the borehole. This liner provides the necessary dimensional integrity for the borehole by supporting the surrounding earthen/rock surface as well as the conduit through which the drilling fluid/cuttings flow upwardly through the annular space surrounding the drill stem. Ultimately, the casing carries the hydrocarbon products from the well.

After the borehole has been drilled to the desired depth in the hydrocarbon-producing formation and the casing has been extended to the bottom of the borehole, the casing is perforated. Perforation is formed as a plurality of holes through the casing along a selected length of the casing. This length is calculated to generally correspond to the vertical thickness of the producing formation. The hydrocarbon products from the formation enter the well through these perforations and are subsequently recovered. This sequence of events is referred to in the art as production. During production, cuttings and sand from the formation pass through the perforations into the well. Further, rust and scale concretions form on and in the casing as a natural consequence of the refractory environment and the chemicals found in this region.

From time to time it is necessary also to treat the formation in order to stimulate production. Acid treatment is one technique for stimulating production. During acid treatment a propping agent such as a specially selected sand is pumped into the well either during or after the acid treatment operation. This procedure is known as acid fracturing and results in a substantial quantity of surplus sand filling the bottom portion of the hole to a depth of thirty or more meters. This sand residue along with the aforementioned cuttings, scale, and the like, must be removed from the well before production can be resumed. In addition to the foregoing debris, elastomeric plugs referred to as frac balls are used to plug selected portions of the casing perforations during the acid fracturing sequence. These frac balls must also be removed.

One recent development is the well cleanout tool of Harrison (U.S. Pat. No. 4,190,113) which involves an elongated body having a pump means connected to a debris-retaining chamber. The pump means is actuated by reciprocating the tubing to cause fluid to move through the tool. Debris in the fluid settles out in the debris-retaining chamber while debris-free fluid flows through an outlet in the upper end of the tool and back into the annular space between the cleanout tool and the casing. Fluid in the casing is recirculated to carry additional debris into the debris-retaining chamber. A splined driveshaft enables the cleanout tool to be rotated while the pump is being reciprocated.

A combination cleanout and drilling tool is disclosed in the reference of Moody et al (U.S. Pat. No. 4,421,182) and is designed to permit cleanout of a borehole in either a hydrostatic or hydraulic operation. Additionally, the tool may be used to drill a formation within the borehole without the need for circulation of the drilling fluid to the surface to remove cuttings from the formation.

Various other types of sand pumps and bailers are shown in the patents of Palm (U.S. Pat. No. 563,055); Swan (U.S. Pat. No. 1,537,201); Gates (U.S. Pat. No. 2,000,750); and Dumble (U.S. Pat. No. 2,180,935).

Experience with these various types of cleanout tools has shown that they are susceptible to becoming fouled by scale and other debris during operation such that the effectiveness of the pumping action for drawing debris into the debris-retention chamber is substantially diminished. One primary cause of this loss of pumping efficiency is in the type, number, and placement of the one-way check valves required. For example, the valves shown in Harrison are extremely susceptible to debris-caused interference such that the valves rapidly lose efficiency. Also, the pump member is located toward the lower end of the cleanout tool where it is exposed to the highest concentration of debris in the incoming, debris-laden fluid so that it is subjected to an extremely high degree of interference with its pumping efficiency. Further, the check valve system of Moody is believed to be highly susceptible to plugging due to the inherent nature of the ball valve-type check valves.

Experience has also shown that these prior art devices do not function well under low fluid level conditions in the well. Low fluid levels are frequently encountered when the well is producing from what is referred to in the trade as a weak formation. A weak formation is one that allows fluid to pass into the formation so that only a relatively low hydrostatic head is possible in the well. This means that it is not possible to use the cleanout tool to pump the fluid out of the well, but the cleanout tool must be used to circulate the limited amount of fluid in the well while at the same time retaining debris in the cleanout tool for subsequent removal from the well.

In view of the foregoing, it would be a significant advancement in the art to provide a cleanout tool whereby the pumping member in the cleanout tool is located toward the upper end of the cleanout tool and at a position above the debris-retention chamber so as to better isolate the pumping member from interference by debris. It would also be an advancement in the art to provide a cleanout tool having novel check valves that are simple in construction and less prone to becoming jammed by debris. An even further advancement in the art would be to provide a cleanout tool that is easily disassembled for cleaning and repair. Such a novel apparatus and method is disclosed and claimed herein.

BRIEF SUMMARY AND OBJECTS OF THE INVENTION

This invention relates to an improved cleanout tool for a deep borehole, the cleanout tool having a pumping piston formed around the upper end of a hollow kelly. Uniquely designed check valves reduce the amount of clogging by debris recovered by the cleanout tool. The cleanout tool includes a single service break and is also easily disassembled for ease in cleaning and repair, if any is required.

It is, therefore, a primary object of this invention to provide improvements in cleanout tools for removing debris from wells.

It is another object of this invention to provide improvements in the method of cleaning debris from a well.

Another object of this invention is to provide a cleanout tool for a well wherein the pumping piston is formed at the upper end of a kelly, the kelly having a hollow throughbore for passage of liquid.

Another object of this invention is to provide a cleanout tool wherein the pumping mechanism is located at the upper end of the cleanout tool where it is substantially isolated from debris collected inside the cleanout tool.

Another object of this invention is to provide a cleanout tool that is easily disassembled for ease of cleaning and replacement of parts subject to wear.

Another object of this invention is to provide a cleanout tool having a plurality of check valves as backup systems in the event one or more check valves is momentarily blocked by debris.

Another object of this invention is to provide check valves that are relatively simple in operation and resistant to blocking by the presence of debris.

These and other objects and features of the present invention will become more readily apparent from the following description in conjunction with the accompanying drawing and appended claims.

DETAILED DESCRIPTION OF THE PREFERRED EMBODIMENT

The invention is best understood by reference to the following description taken in conjunction with the accompanying drawing wherein like parts are designated by like numerals throughout.

DETAILED DESCRIPTION

Figure 1:
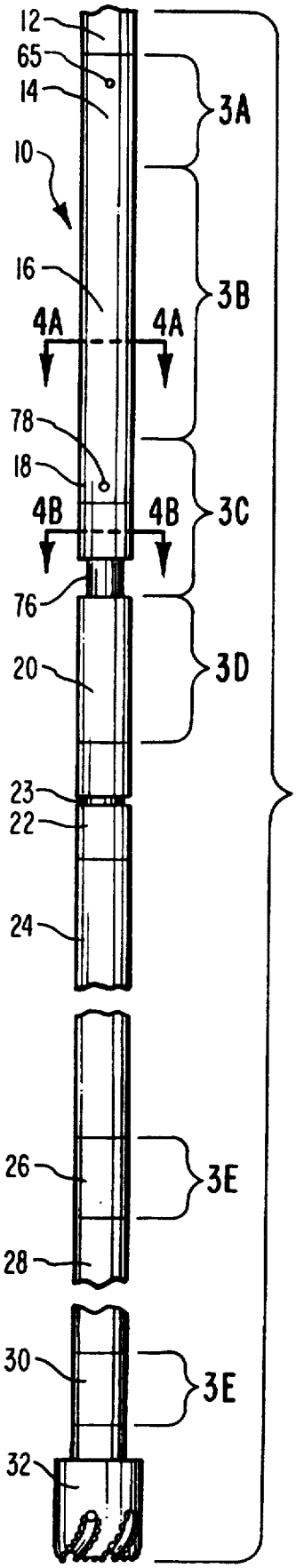
FIG. 1 is a side elevation of the novel cleanout tool of this invention shown in the environment of a drill stem and a reamer bit with portions shown broken away to foreshorten the various elements of this invention for ease of presentation.

Referring now more particularly to FIG. 1, the novel cleanout tool of this invention is shown generally at 10 and includes a drill stem 12; a first, upper valve section 14 (shown in an enlarged cross sectional view at FIG. 3A); a piston section 16 (shown in an enlarged, cross sectional view at FIG. 3B); a kelly driver section 18 (shown in an enlarged, cross sectional view at FIG. 3C); a second, upper valve section 20 (shown in an enlarged, cross sectional view at FIG. 3D); a conventional safety joint 22; an upper debris reservoir 24; a first, lower check valve 26 (shown in an enlarged, cross sectional view at FIG. 3E); a lower debris reservoir 28; a second, lower check valve 30 (identical to first, lower check valve 26, FIG. 3E); and a conventional reamer bit 32. Drill stem 12 is a conventional drill stem commonly used in the industry in association with a rotary drill system (not shown). Drill stem 12 is used to raise and lower all or part of cleanout tool 10, as will be described more fully hereinafter, in addition to rotating reamer bit 32.

Operationally, reamer bit 32 is used to break up packed sand and scale as well as to cut through cement plugs, and the like. The fragmented debris (not shown) is then drawn into cleanout tool 10 where it is held in both upper debris reservoir 24 and lower debris reservoir 28. First, lower check valve 26 and second, lower check valve 30 are configured as one-way check valves to prevent the backflow of debris from the respective debris reservoirs, upper debris reservoir 24 and lower debris reservoir 28. Fluid pumped upwardly through cleanout tool 10 carries debris upwardly (not shown) in the form of a slurry through second, lower check valve 30 and first, lower check valve 26. During the cyclic operation of cleanout tool 10 most of the debris (not shown) settles out into upper debris reservoir 24.

Figure 2:
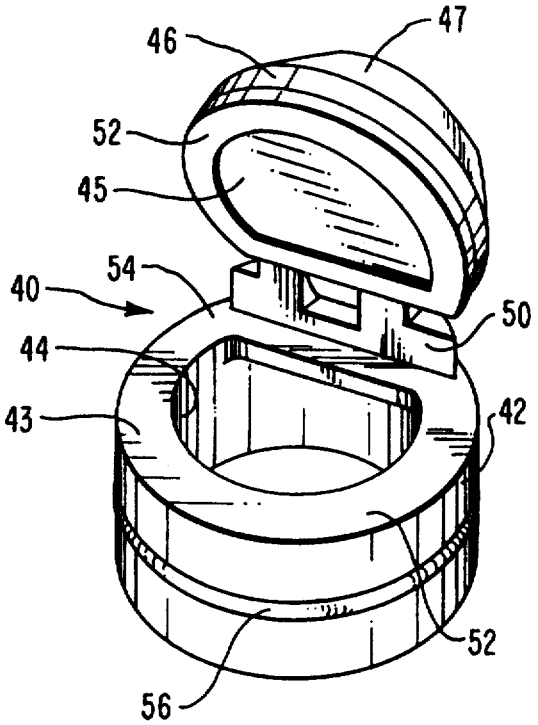
FIG. 2 is a perspective view of one of the novel check valves of this invention.
Figure 3A:
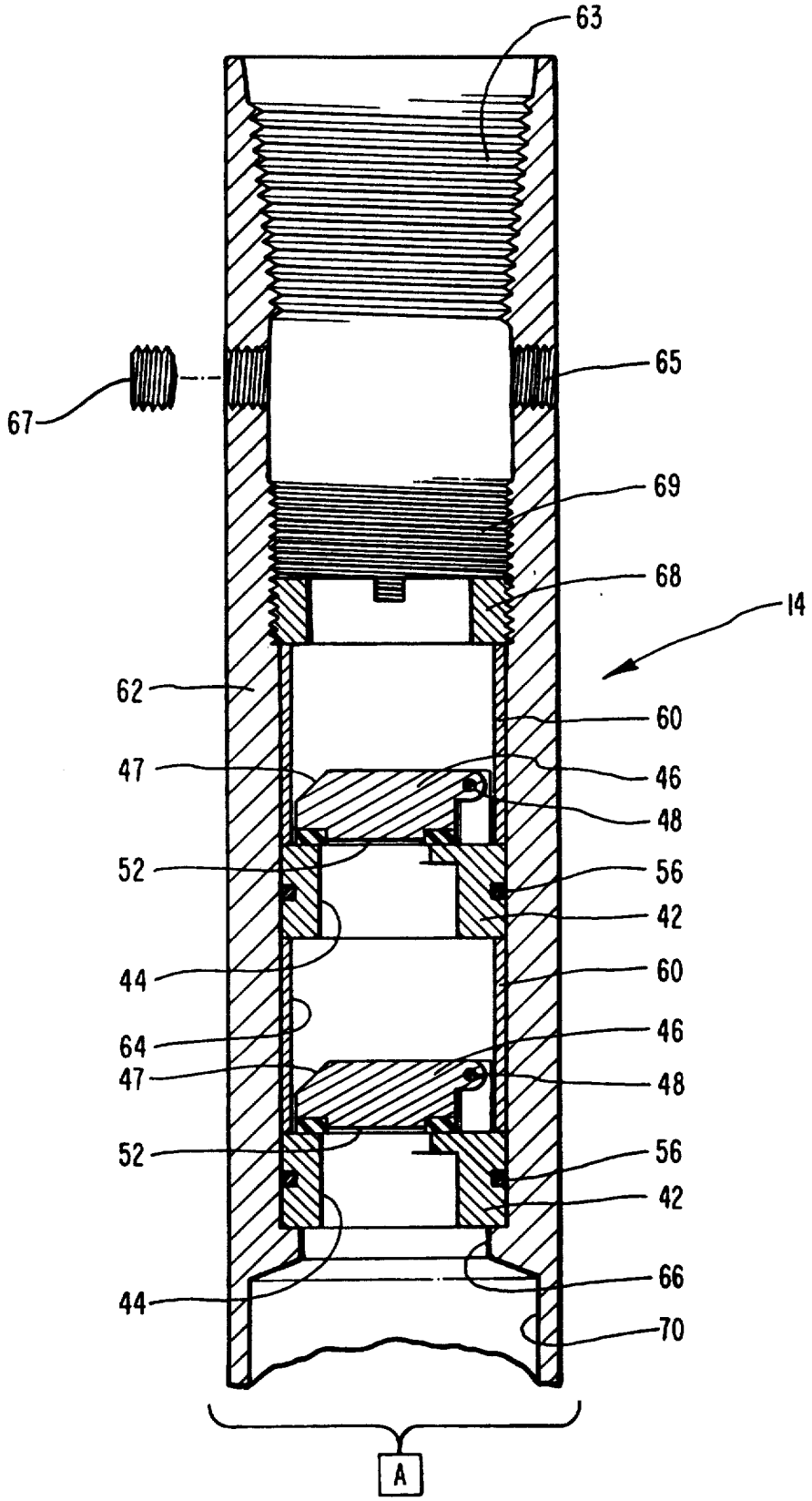
FIG. 3A is an enlarged, cross sectional view of the first, upper valve assembly shown by 3A of FIG. 1.

With reference now to FIG. 2, a check valve is shown generally at 40 and includes a cylindrical valve body 42 having a hollow throughbore 44. A riser 50 extends upwardly along one edge of valve body 42 and serves as a pivotal support for a valve member 46 pivotally mounted thereto by a pivot 48 (FIGS. 3A, 3D and 3E). The upper face of valve body 42 is formed as a valve seat 43 and is configured with a D-shaped configuration to accommodate the encroachment of riser 50 onto the area represented by valve seat 43. A circumferential shelf 54 surrounds the circular portion of valve seat 43 and riser 50 to form a circular platform 54 against which a spacer 60 (FIGS. 3A, 3D and 3E) is supported as will be discussed more fully hereinafter.

Valve member 46 is specifically configured with its mass supported off center of pivot 48 to thereby allow it to be pulled downwardly by the force of gravity. Valve member 46 cooperates in sealing relationship with valve seat 43. Valve member 46 has a bottom face 45 with a D-shaped recess formed in the outer perimeter of bottom face 45 to receive a corresponding, D-shaped gasket 52. Gasket 52 provides a sealing relationship between valve member 46 and valve seat 43.

Importantly, check valve 40 is mounted with its axis oriented vertically with valve member 46 in the upper orientation. This design allows upwardly flowing liquid and/or liquid-debris slurry (not shown) to lift valve member 46 into the open position as long as there is flow in the upward direction. As this flow drops to zero, the force of gravity pulls valve member 46 downwardly with gasket 52 brought into sealing contact against valve seat 43. As mounted on riser 50, valve member 46 is always in an overcenter position so that the force of gravity readily pulls it downwardly into the closed position.

Valve body 42 includes a circumferentially extending platform 54 which is formed around the perimeter of valve body 42 and acts as an abutment surface to support spacer 60 (FIGS. 3A, 3D, and 3E). Spacer 60 securely holds check valve 40 in the desired position inside the respective valve cavities. It will be noted that platform 54 also extends behind riser 50 so as to provide a full 360 degree support surface for spacer 60 (FIGS. 3A, 3D, and 3E). Valve member 46 also has a beveled surface 47 that provides a certain degree of nesting relationship with the inner surface of spacer 60 (FIGS. 3A, 3D, and 3E) so as to allow valve member 46 to open to the fullest extent possible. An 0 ring 56 circumferentially girds valve body 42 to seal check valve 40 in the particular valve cavity in which it is placed as will be discussed more fully hereinafter with respect to the apparatus of FIGS. 3A, 3D, and 3E.

Referring now to FIG. 3A, the first, upper valve section is shown generally at 14 and includes a length of drill stem 62 having a valve cavity 64 formed in the upper end thereof. Valve cavity 64 is dimensionally configured to receive two check valves 40 therein with 0 rings 56 providing the necessary sealing relationship between check valves 40 and valve cavity 64. The lower end of valve cavity 64 includes an annular support ring 66 as an abutment for lower check valve 40. A lower spacer 60 rests on the lower check valve 40 to provide a separator between the two check valves 40 or, more particularly to allow valve member 46 on the lower check valve 40 to be freely operable without contacting valve body 40 of the upper check valve 40. An annular locking nut 68 is threadedly engaged in a set of internal threads 69 and is used to secure the entire assembly of the two check valves 40 and spacers 60 in the orientation shown herein. This entire subassembly constitutes a valve section, namely, first, upper valve section 14. Similar valve sections are also shown in FIG. 3D which will be discussed more fully hereinafter.

The upper end of drill stem 62 is the upper end of cleanout tool 10 (FIG. 1) and is configured with a conventional, conical threaded section 63 for threadedly connecting cleanout tool 10 to a mating end of drill stem 12 (FIG. 1). Threads 63 are referred to in the trade as the "box end" of a length of drill pipe. A plurality of ports 65 are formed in the wall of first, upper valve section 14 between internal threads 69 and conical threaded section 63. Ports 65 allow liquid (not shown) flowing upwardly through upper valve section 14 to return to the annular space (not shown) between cleanout tool 10 (FIG. 1) and the surrounding casing of the well (not shown) into which cleanout tool 10 has been inserted. Ports 65 are threaded so as to receive correspondingly threaded plugs, one of which is shown herein as plug 67. Plugs 67 allow the operator (not shown) to seal ports 65 to thereby preclude fluid from escaping through ports 65 into the annular space (not shown) surrounding cleanout tool 10 (FIG. 1). Instead, with ports 65 being plugged the fluid is pumped upwardly through drill stem 12 (FIG. 1) and recovered at the surface.

Figure 3B:
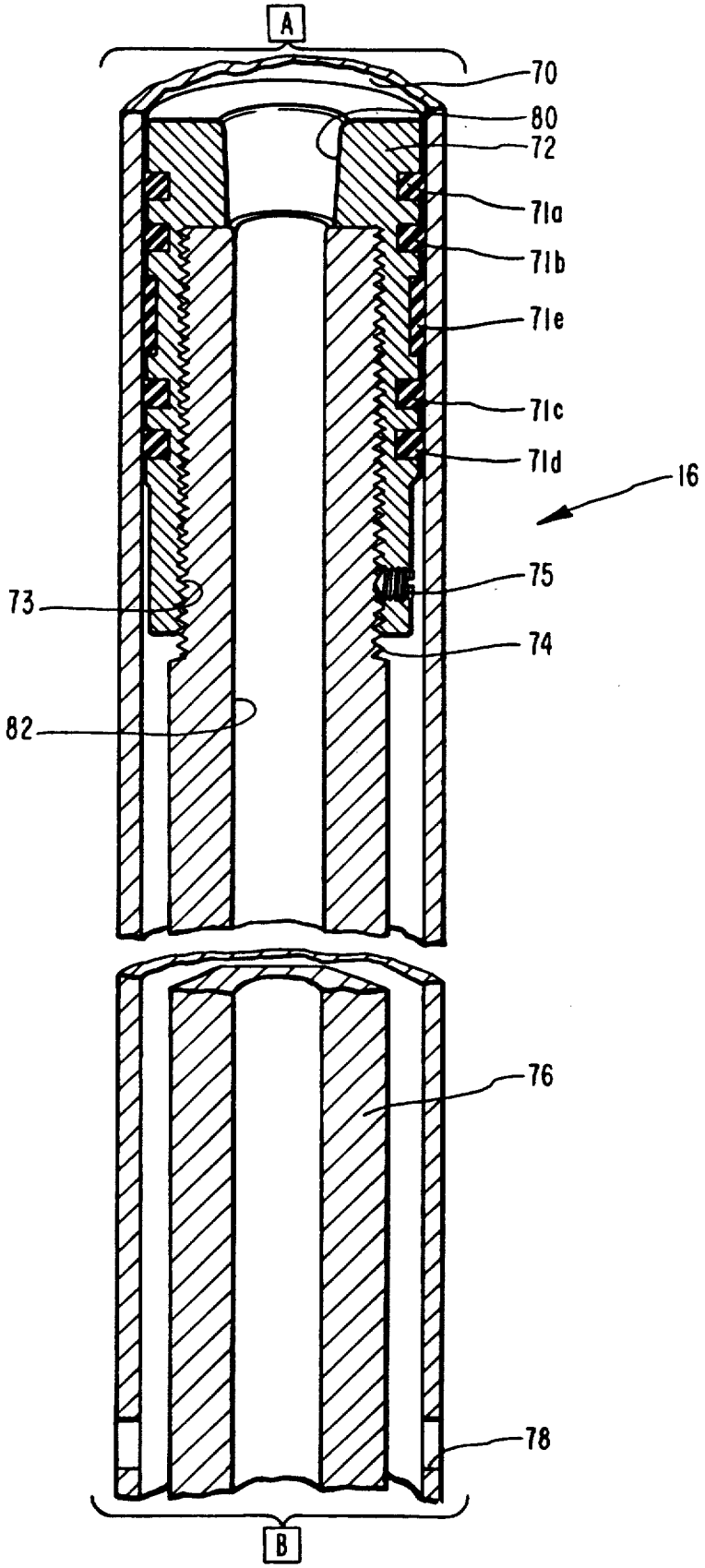
FIG. 3B is an enlarged, cross sectional view of the piston section shown by 3B of FIG. 1.
Figure 4A:
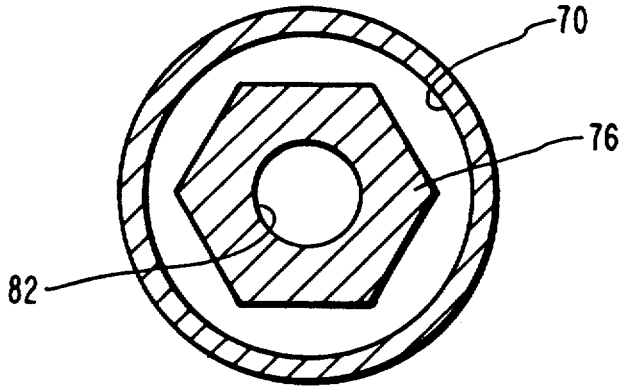
FIG. 4A is an enlarged, cross sectional view of the kelly inside the pumping chamber and taken along lines 4A—4A of FIG. 1.

Referring also to FIG. 3B, piston section 16 includes a piston cylinder 70 which terminates at its upper end at the annular support ring 66 (see also FIG. 3A). Piston cylinder 70 is an elongated cylinder operable to slidingly receive therein in sealing relationship a piston 72 threadedly mounted at mating threads 73 and 74 on the end of a hexagonal kelly 76. A set screw 75 securely interlocks piston 72 to kelly 76. Piston 72 includes a plurality of piston rings 71*a*–71*d* in addition to a wear ring 71*e*, all of which are conventional devices for assuring a sealing relationship for the sliding cooperation between piston 72 and piston cylinder 70. The lower end of piston cylinder 70 includes a plurality of ports 78 to allow for pressure equalization between kelly 76 and piston 72 as piston 72 reciprocatingly operates along the length of piston cylinder 70. The interrelationship between kelly 76 and piston cylinder 70 is best seen in FIG. 4A. Piston 72 includes a coaxial throughbore 80 in alignment with a corresponding, coaxial throughbore 82 in kelly 76.

Downward movement of piston 72 relative to cylinder 70 creates a partial vacuum inside cylinder 70 closing check valves 40 in first, upper valve section 14 and opening all other check valves 40 below piston section 16. The resulting negative pressure inside cylinder 70 allows fluid to pass into cylinder 70. Upward movement of piston 72 forces the fluid out cylinder 70 and upwardly through check valves 40 in first, upper valve section 14. Correspondingly, the absence of negative pressure allows all other check valves 40 to close under the force of gravity thereby shutting off any return flow downwardly through cleanout tool 10 (FIG. 1). The upward movement of piston 72 expels essentially all of the fluid inside cylinder 70 so that minimal residual fluid is present inside cylinder 70 prior to the repeat downstroke of piston 72.

Figure 3C:
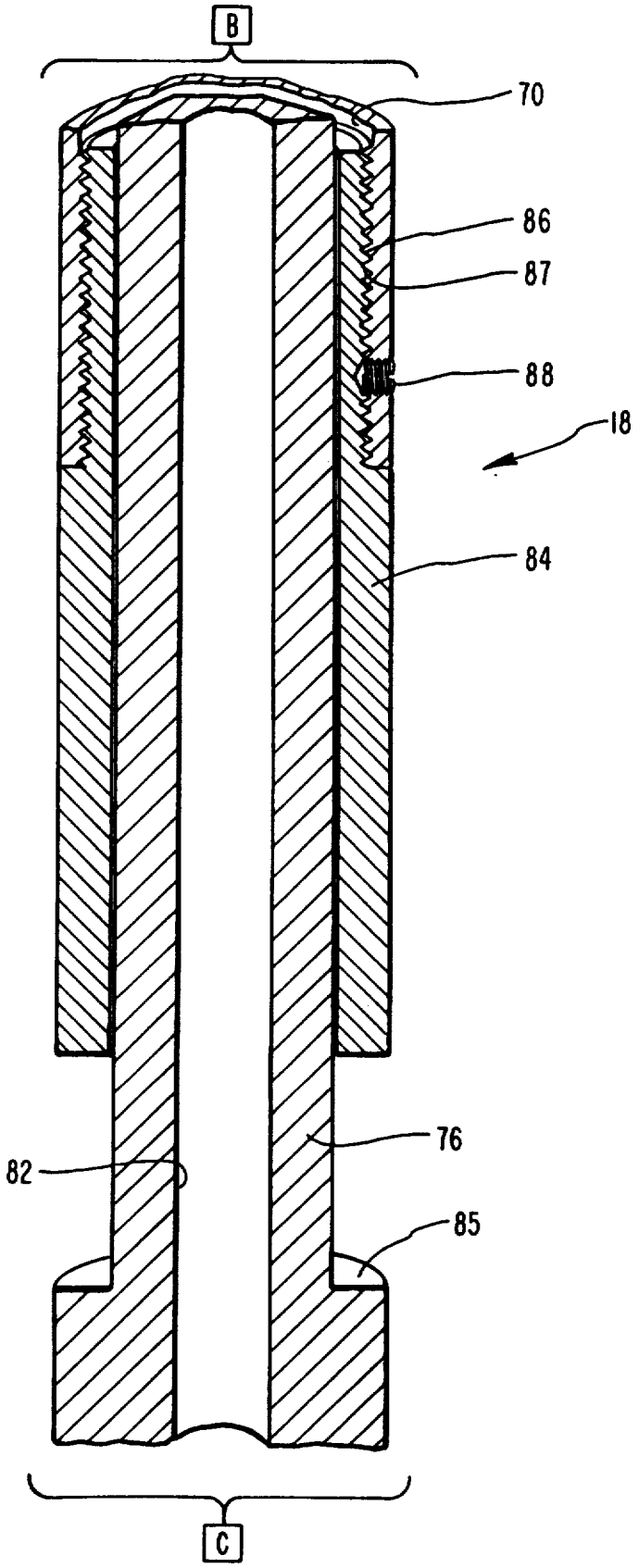
FIG. 3C is an enlarged cross sectional view of the kelly driver section shown by 3C of FIG. 1.
Figure 3D:
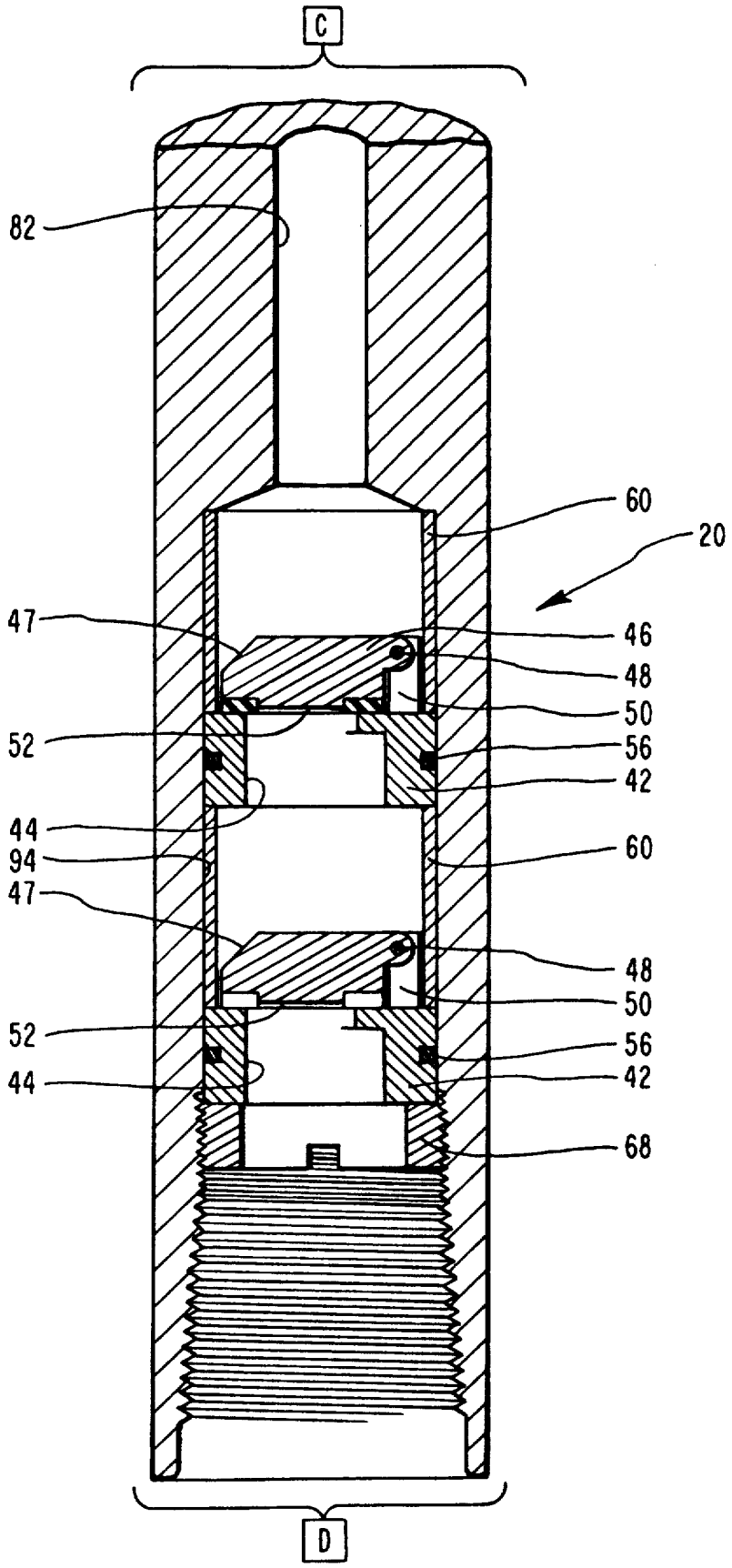
FIG. 3D is an enlarged, cross sectional view of the second, upper valve assembly shown by 3D of FIG. 1.
Figure 3E:
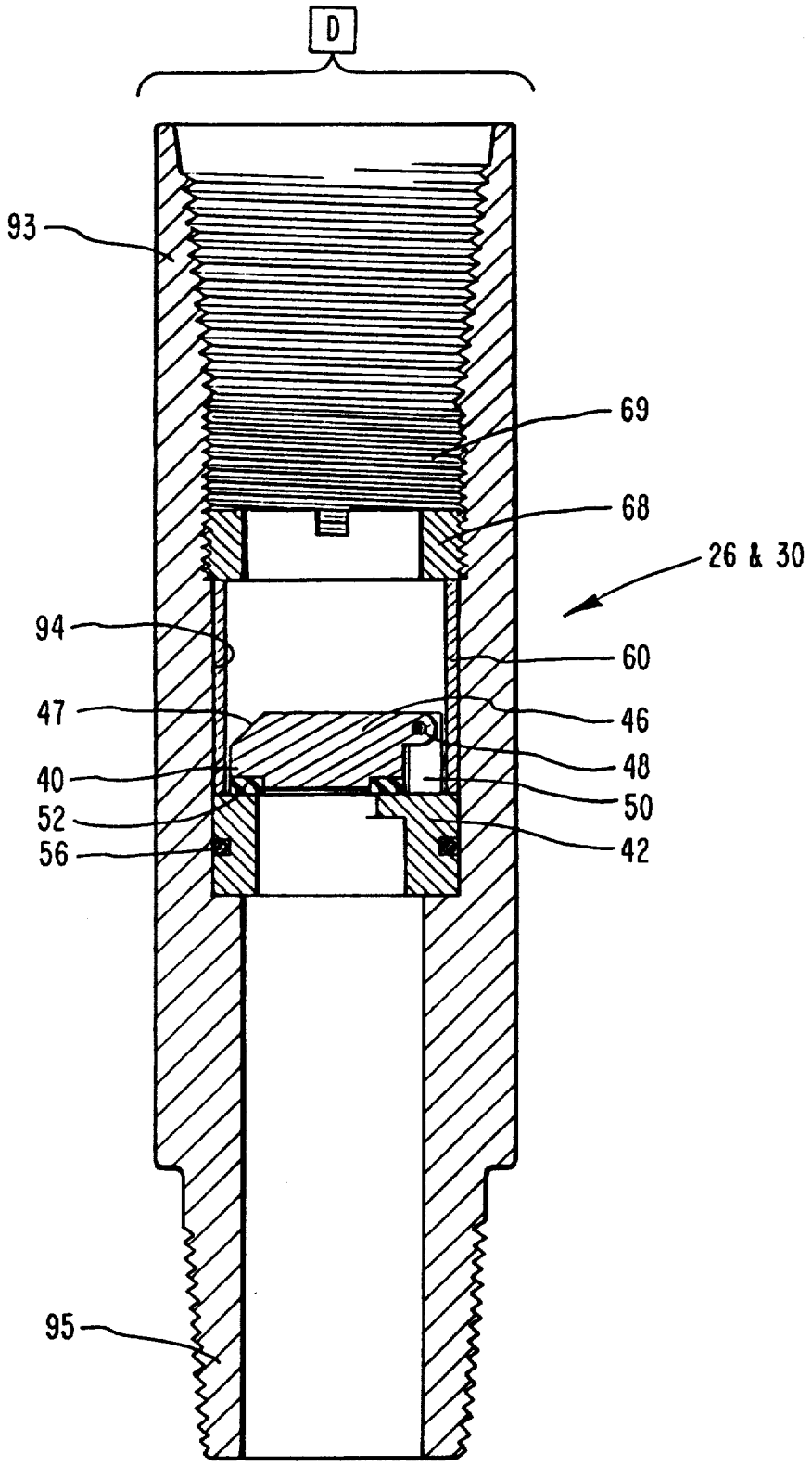
FIG. 3E is an enlarged, cross sectional view of a lower check valve shown by 3E of FIG. 1.
Figure 4B:
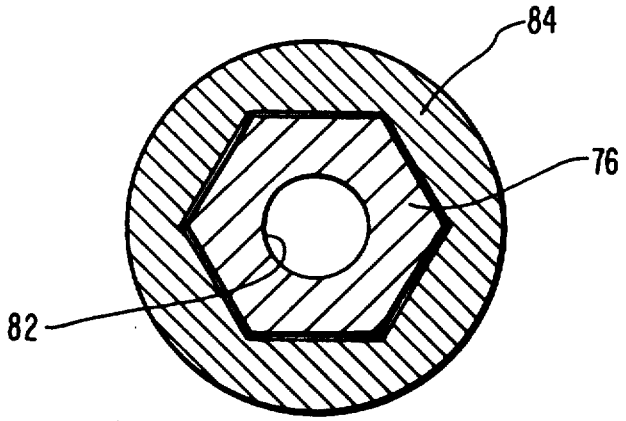
FIG. 4B is an enlarged, cross sectional view of the kelly inside the kelly driver and taken along lines 4B—4B of FIG. 1.

Referring now to FIG. 3C, the lower end of kelly 76 is shown as being slidingly engaged in a kelly driver 84. The relationship between kelly 76 and kelly driver 84 is best seen in FIG. 4B. Kelly driver 84 is threadedly engaged to the lower end of cylinder 70 at mating threads 86 and 87. A set screw 88 securely interlocks kelly driver 84 to cylinder 71. This interlocking relationship allows torsional forces exerted on drill stem 12 to be transmitted across cylinder 71 to the rest of cleanout tool 10. An abutment surface 85 limits the downward travel of kelly driver 84.

Separation of kelly driver 84 from kelly 76 at threads 86 and 87 provides a single service break for access to the internal components of pumping section 16. All other known cleanout tools (not shown) incorporate several service break points with the result that these prior art cleanout tools generally require several trips to remove debris from the cleanout tool. The configuration of the present invention means fewer trips out of the borehole for cleanout tool 10 along with a significantly reduced likelihood that cleanout tool 10 will inadvertently come apart during operation.

Referring now to FIG. 3D, the second, upper valve section 20 is shown in a cross sectional view in fluid communication with kelly throughbore 82. Second, upper valve section 20 includes a valve cavity 94 with two check valves 40 (FIG. 2) superimposed one above the other with spacers 60 interposed between and above check valves 40. A locking nut 68 secures check valves 40 and spacers 60 inside valve cavity 94. Comparing second, upper valve section 20 with first, upper valve section 14 (FIG. 3A) it will be noted that the placement of the locking nut 68 is reversed as a result of the direction of insertion of check valves 40 and spacers 60. Importantly, check valves 40 in this second, upper valve section 20 operate identically to those in first, upper valve section 14 (FIG. 3A) in providing for control of flow of liquid through cleanout tool 10 (FIG. 1).

With reference also to FIGS. 3A and 3B, an important distinction between first, upper valve section 14 and second, upper valve section 20 is that their respective operational sequences are opposite since each is at an opposite end of piston section 16. In particular, when piston 72 is moved downwardly a partial vacuum is created inside cylinder 70 so that check valves 40 in first, upper valve section 14 are closed while check valves 40 in second, upper valve section 20 are opened by the resulting upward flow of fluid caused by the resulting negative pressure above them. As piston 72 is pushed upwardly into cylinder 70 check valves 40 in first, upper valve section 14 are opened to permit the escape of fluid from cylinder 70. Simultaneously, the loss of the foregoing negative pressure allows the force of gravity to close check valves 40 in second, upper valve section 20.

With reference to FIG. 3E, first and second, lower valve sections 26 and 30 are shown as the same unit since both are identical. Each contains a single check valve 40 and mating spacer 60 which are secured in a valve cavity 95 by a locking nut 68. The upper end of each of first and second, lower valve sections 26 and 30 are configured with a conventional threaded section which is referred to in the trade as a box end 93 while the lower end is referred to a pin end 95.

Referring to all of the figures, cleanout tool 10 is inserted into a deep borehole (not shown) according to conventional techniques. In particular, reamer bit 32 is threadedly mounted to the lower end of second, lower valve section 30 which is, in turn, coupled to the bottom end of a length of drill stem referred to as the lower debris reservoir 28. The next valve section, first, lower valve section 26, is then connected to the upper end of lower debris reservoir 28. A plurality of sections of drill stem constituting upper debris reservoir 24 are thereafter joined end-to-end on top of first, lower valve section 26 as reamer bit 32 is lowered into the borehole (not shown). The total length of upper debris reservoir 24 is a function of the number of sections of drill stem assembled together as reamer bit 32 is lowered into the borehole (not shown). To assure proper functioning of cleanout tool 10, a sufficient number of sections are joined together into upper debris reservoir 24 so as to provide at least 5,000 pounds (2,268 Kilograms) weight below piston section 16.

The upper end of debris reservoir 24 is terminated by a conventional safety joint 22 which is configured with a right hand, high pitch thread to allow the operator (not shown) to rotate drill stem 12 to the left and thereby selectively separate cleanout tool 10 at safety joint 22. The likelihood of this procedure being required is remote if the proper operating sequence is followed for the operation of cleanout tool 10.

Second, upper valve section 20 is joined to the breakaway section of safety joint 22 and is formed at the lower end of kelly 76. Kelly driver section 18 is slidingly engaged to kelly 76 as shown in the cross sectional view of FIG. 4B so as to transmit torsional forces along the entire length of cleanout tool 10 while at the same time providing for the longitudinal, sliding cooperation between piston 72 inside cylinder 70 of piston section 16. The upper end of piston section 16 includes the first, upper valve section 14 which is mounted to the lower end of drill stem 12.

Operationally, cleanout tool 10 is lowered into the borehole (not shown) until reamer bit 32 engages the debris or other obstruction in the borehole at which time pumping action is commenced. This is done by lowering drill stem 12 another meter or so to cause piston 72 to be telescopically received inside cylinder 70. Thereafter, cleanout tool 10 is rapidly pulled off the bottom of the borehole five or six meters which, in turn, pulls piston 72 to the bottom end of cylinder 70. This action creates a partial vacuum inside cylinder 70 causing check valves 40 in first upper valve section 14 to close while simultaneously opening all other check valves 40 in second, upper valve section 20; first, lower check valve 26; and second, lower check valve 30 so as to allow liquid and debris (not shown) to pass upwardly into lower debris reservoir 28 and upper debris reservoir 24.

Cleanout tool 10 is again lowered into contact with the debris in the bottom of the borehole causing piston 72 to move upwardly into cylinder 70 and to displace liquid therein upwardly through first, upper valve section 14. The liquid thus displaced from cylinder 70 is ejected from drill stem 12 through ports 65 where the liquid is then allowed to recirculate through the annular space surrounding cleanout tool 10.

The foregoing reciprocatory movement on cleanout tool is continued as the debris from the borehole is pulled into the lower, debris reservoir 28 and upper debris reservoir 24. Periodically, drill stem 12 is rotated so as to rotate reamer bit 32 in the interim between the pumping cycles of piston section 16. Combined rotation of reamer bit 32 and stroking of piston section 16 is generally not recommended due to the torsional forces imposed on kelly 76. The recommended procedure is to stop rotation, pull reamer bit 32 off the bottom, and then stroke the pumping action of piston section 16. This sequence relieves any torque which may have accumulated along the length of drill stem 12 and cleanout tool 10.

Advantageously, each of check valves 40 securely closes in sealing relationship when closed at the appropriate time in the pumping cycle so as to provide significant improvements in the pumping action provided by piston section 16. Further, each of check valves 40 can be quickly and easily removed, cleaned, and refurbished or replaced as may be required. The double check valves 40 in first and second, upper valve sections 14 and 20 also provide a significant improvement in the art since even though a single check valve 40 should be adequate, the presence of a second check valve 40 provides a valuable margin of safety in the event the other check valve 40 becomes blocked by debris.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A cleanout tool for a borehole having a low fluid level comprising:

a first, upper valve section and a second, upper valve section, each valve section comprising:

a valve cavity;

a first check valve and a second check valve, each of said check valves having a pivotally mounted valve body, said valve body being releasably held in a closed position by gravitational forces;

a first, cylindrical spacer for said first check valve and a second, cylindrical spacer for said second check valve, each of said cylindrical spacers providing a housing for unrestricted operation of said valve body; and a locking nut for securing said first and second check valves and s id first and second spacers in said valve cavity;

a pumping chamber and a kelly driver between said first, upper valve section and said second, upper valve section said pumping chamber comprising:

an elongated cylinder;

a piston slidingly operable in said cylinder in sealing relationship therewith, said piston having a first, hollow, coaxial throughbore;

a kelly affixed to said piston, said kelly including a second hollow, coaxial throughbore in fluid communication with said first, hollow, coaxial throughbore in said piston; and said kelly driver being slidably engaged to said kelly and releasably interlocked with said elongated cylinder and operable to transmit torsional forces from said elongated cylinder to the rest of the cleanout tool below said kelly driver;

a third check valve and a fourth check valve below said second, upper valve section;

an upper debris reservoir between said second, upper valve section and said third, check valve, said upper debris reservoir comprising a plurality of lengths of hollow drill pipe; and a lower debris reservoir between said third check valve and said fourth, check valve, said lower debris reservoir comprising at least one length of hollow drill pipe.

2. The cleanout tool defined in claim 1 wherein said check valve comprises a cylindrical body having a coaxial open throughbore with said open throughbore oriented vertically and with said valve body pivotally mounted above said open throughbore, said open throughbore terminating in a flat surface, said valve body having a flat bottom face, said flat bottom face engaging said flat surface in a sealing relationship.

3. The cleanout tool defined in claim 2 wherein said flat bottom face includes an elastomeric seal circumscribing said open throughbore, said seal cooperating with said flat surface of said valve body to enhance said sealing relationship.

4. The cleanout tool defined in claim 2 wherein said cylindrical body includes an annular detent as an abutment surface for said cylindrical spacer.

5. The cleanout tool defined in claim 2 wherein said cylindrical body includes a circumferential groove and an 0 ring in said circumferential groove, said 0 ring providing a sealing relationship between said cylindrical body and said valve cavity.

6. The cleanout tool defined in claim 1 wherein said valve body comprises an annular bevel around an upper surface of said valve body, said annular bevel providing a limited degree of nesting relationship between said valve body and said cylindrical spacer when said valve body is raised into contact with said spacer.

7. A cleanout tool for a borehole having a low fluid level comprising:

a first, upper valve section comprising a first valve cavity having first and second check valves removably sealed therein with a first cylindrical spacer mounted above said first check valve and a second cylindrical spacer mounted between said first check valve and said second check valve, said first and second cylindrical spacers providing spatial separation for said first and second check valves, a first annular locking nut for securing said first and second check valves and said first and second cylindrical spacers in said first valve cavity;

a pumping chamber below said first, upper valve section and comprising an elongated cylinder with a piston slidingly operable in said elongated cylinder, said piston having a first coaxial, hollow throughbore and mounted on the end of a kelly, said kelly having a second coaxial, hollow throughbore in fluid communication with said first, coaxial hollow throughbore;

a kelly driver mounted to said elongated cylinder of said pumping chamber and in sliding engagement with said kelly;

a second, upper valve section comprising a second valve cavity having third and fourth check valves removably sealed therein with a third cylindrical spacer mounted above said third check valve and a fourth cylindrical spacer mounted between said third check valve and said fourth check valve, said third and fourth cylindrical spacers providing spatial separation for said third and fourth check valves, a second annular locking nut for securing said third and fourth check valves and said third and fourth cylindrical spacers in said second valve cavity;

an upper debris reservoir comprising a plurality of lengths of hollow drill stem;

a fifth, check valve comprising a third valve cavity having said fifth check valve removably sealed therein with a fifth cylindrical spacer providing spatial separation for said fifth check valve, a third annular locking nut for securing said fifth check valve and said fifth cylindrical spacer in said third valve cavity;

a lower debris reservoir comprising at least one length of hollow drill stem; and a sixth check valve comprising a fourth valve cavity having said sixth check valve removably sealed therein with a sixth cylindrical spacer providing spatial separation for said sixth check valve, a fourth annular locking nut for securing said sixth check valve and said sixth cylindrical spacer in said fourth valve cavity.

8. The cleanout tool defined in claim 7 wherein each of said check valves comprises a cylindrical body having a coaxial, open throughbore, said open throughbore being oriented vertically and with a valve body pivotally mounted above said open throughbore, said open throughbore terminating in a flat surface, said valve body having a flat bottom face, said flat bottom face engaging said flat surface in a sealing relationship.

9. The cleanout tool defined in claim 8 wherein said flat bottom face includes an elastomeric seal circumscribing said open throughbore, said seal cooperating with said flat surface of said valve body to enhance said sealing relationship.

10. The cleanout tool defined in claim 8 wherein said cylindrical body includes an annular detent as an abutment surface for said cylindrical spacer.

11. The cleanout tool defined in claim 8 wherein said cylindrical body includes a circumferential groove and an O ring in said circumferential groove, said O ring providing a sealing relationship between said cylindrical body and said valve cavity.

12. The cleanout tool defined in claim 8 wherein said valve body comprises an annular bevel around an upper surface of said valve body, said annular bevel providing a limited degree of nesting relationship between said valve body and said spacer when said valve body is raised into contact with said spacer.

13. A method for removing debris from a borehole having low level of liquid therein comprising:

preparing a plurality of valve sections comprising a first, upper valve section;

a second, upper valve section;

a first, lower check valve; and a second, lower check valve;

each of said first and second, upper valve sections including a valve cavity with a pair of check valves inserted into each aid valve cavity and a pair of cylindrical spacers in each said valve cavity to provide operational clearance for said check valves in said valve cavity and a locking nut for securing said pair of check valves and said pair of cylindrical spacers in said valve cavity each of said first, lower check valve and said second, lower check valve including a single check valve and a single cylindrical spacer;

forming a pumping section by mounting a piston on an end of a kelly, both said piston and said kelly having a coaxial throughbore and inserting said piston in a cylinder in sealing relationship;

engaging said cylinder to a kelly driver, said kelly driver slidably engaging said kelly in a fixed relationship as to rotation;

assembling said plurality of valve sections, said pumping section and said kelly driver into a cleanout tool by mounting said second, lower check valve on a lower end of a lower debris reservoir assembled from at least one length of hollow drill stem and mounting an upper debris reservoir above said lower debris reservoir with said first, lower check valve being interposed between said upper debris reservoir and said lower debris reservoir, said upper debris reservoir including a plurality of lengths of said hollow drill stem and having said second, upper valve section mounted to the upper end of said upper debris reservoir with said kelly driver mounted to said second, upper valve section thereby mounting said pumping section to said second, upper valve section through said kelly driver, said first upper valve section being mounted to said pumping section thereby completing said cleanout tool;

affixing said cleanout tool to a drill stem while lowering said cleanout tool into said borehole to a position adjacent the bottom of said borehole;

removing debris from said borehole by cycling said pumping section to pull said liquid and debris into said lower debris reservoir and said upper debris reservoir through said second, lower check valve and said first, lower check valve section with said liquid passing upwardly through said second, upper valve section, said pumping section and said first, upper valve section while settling said debris in said lower debris reservoir and said upper debris reservoir, said first and second upper valve sections and said first and second lower check valves assuring a sealingly closure against reverse flow of liquid through said cleanout tool; and selectively expelling said liquid from said cleanout tool at a position above said first, upper valve section.

14. The method defined in claim 13 wherein said selectively expelling step includes forming holes in said cleanout tool above said first, upper valve section thereby directing said liquid out of said cleanout tool.

15. The method defined in claim 14 wherein said forming step includes selectively plugging said holes and thereby pumping said liquid out of said borehole with said cleanout tool.

* * * * *